United States Patent [19]

Saito

[11] Patent Number: 4,918,265

[45] Date of Patent: Apr. 17, 1990

[54] LEAF SPRING SWITCH AND SWITCH ASSEMBLY

[76] Inventor: Takashi Saito, Parkside Mansion 302, 29-4 Kumano-chyo, Itabashi-ku, Tokyo, Japan

[21] Appl. No.: 307,422

[22] Filed: Feb. 7, 1989

[51] Int. Cl.[4] ..... H01H 25/04; H01H 1/26

[52] U.S. Cl. ..... 200/6 A; 200/246; 200/283

[58] Field of Search ..... 200/5 R, 6 A, 238, 239, 200/245, 246, 247, 283, 557

[56] References Cited

U.S. PATENT DOCUMENTS

| | | | |
|---|---|---|---|
| 2,548,103 | 4/1951 | French | 200/247 |
| 3,099,735 | 7/1963 | Roeser | 200/283 X |
| 3,126,466 | 3/1964 | Schwartz | 200/283 X |
| 3,708,636 | 1/1973 | Sobchak | 200/6 A |
| 3,978,303 | 8/1976 | Miyata | 200/246 X |
| 4,181,827 | 1/1980 | Diepeveen | 200/557 X |
| 4,459,440 | 7/1984 | Wiczer | 200/246 X |
| 4,749,826 | 6/1988 | Saito | 200/6 A |
| 4,769,517 | 9/1988 | Swinney | 200/6 A |

*Primary Examiner*—J. R. Scott

*Attorney, Agent, or Firm*—Notaro & Michalos

[57] ABSTRACT

A leaf spring switch device is composed of an L-shaped base member having a long portion and a short portion. A pair of leaf spring contactors extend through the short portion of the base member and have contacts at one end and terminals at opposite ends. An actuator is mounted on one contactor to move it with respect to the other. The contactors extend along the long portion. The lengths of the long and short portions of the base member are selected to be the same as long and short dimensions of a conventional microswitch with the width of the long portion being one half the length of the short portion. In this way, the leaf spring switch device of the present invention is interchangeable with a conventional microswitch.

2 Claims, 4 Drawing Sheets

LEAF SPRING SWITCH AND SWITCH ASSEMBLY

BACKGROUND OF THE INVENTION

1. Field of the Invention

This invention relates to a switch device and a switch assembling using the switch device.

2. Description of the Prior Art

In the past, there is a small push-button type switch device called a microswitch which is used as a switch device for various apparatuses. This microswitch is designed so that as shown in FIG. 1, a fixed contact 2 and a movable contact 3 are provided within a case 1 made of synthetic resin, said fixed contact 2 being formed integral with one terminal 4, said movable contact 3 being provided on a movable member 6*a* on which a plate spring 5 acts and being electrically connected to the other terminal 7 through an actuator member 6*b*. A movable contact is operated by a push button 8 mounted on the case 1 together with the movable member 6*a* so that the push button 8 may be moved into and away from the case 1, the push button 8 being actuated by means of an actuator 9 having one end thereof pivotably engaged with the case 1.

While the conventional microswitch as described above is not complicated in structure, in a switch assembly or the like for a television game machine, for example, which uses a number of microswitches of this kind in a single apparatus, a switch device which is simpler in structure and can be produced at less cost has been demanded.

OBJECT OF THE INVENTION

A principal object of this invention is to provide a switch device which replaces a conventional microswitch and which is simple in structure, involves less trouble and can be produced at less cost.

A further object of this invention is to provide a switch assembly particularly for a television game machine which uses such a switch device as described above.

DETAILED DESCRIPTION OF THE PREFERRED EMBODIMENTS

FIGS. 2 to 6 show a leaf spring switch device according to this invention, in which a base member having a substantially L-shape plane formed, for example, of a synthetic resin, is indicated as 10, and a pair of leaf spring contactors 11 and 12 are mounted on a short portion 10*a* of the base member 10. The contactors 11 and 12 extend through the short portion 10*a* and somewhat obliquely along a long portion 10*b* of the base member 10. One end of contactors 11 and 12 carry respective terminals 11*a* and 12*a*, and the opposite end of the contactors 11 and 12 carry respective contacts 11*b* and 12*b*. An actuator 13 made of a synthetic resin is mounted on the leaf spring contactor 12. The lengths and thicknesses of the short portion 10*a* and long portion 10*b* are designed to be the same as those of a conventional microswitch. The widths of the short portion 10*a* and long portion 10*b* are about the same. The width of the long portion 10*b* is about half the length of the short portion 10*a*. The short portion 10*a* and long portion 10*b* each have mounting holes 10*c* and 10*d* which are diagonally positioned with respect to each other. The mounting hole 10*d* is in the form of a slot.

Figure 1:
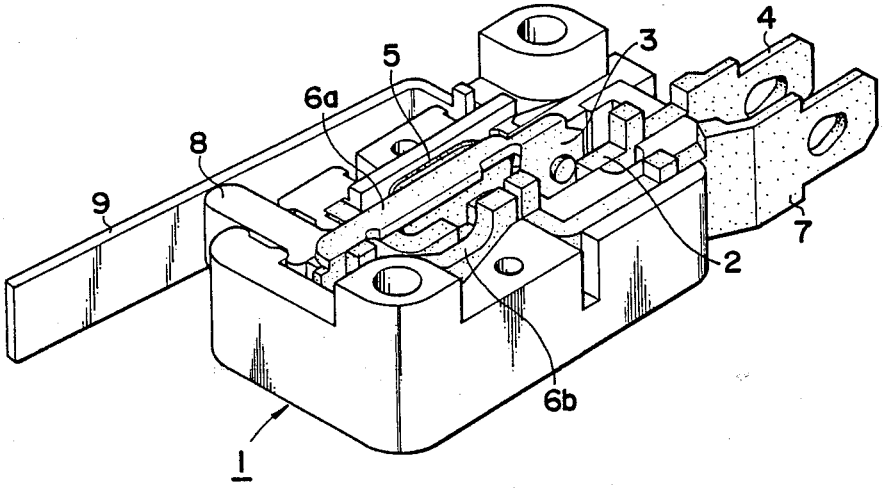
FIG. 1 is a plan view of a well known microswitch with a lid removed.
Figure 2:
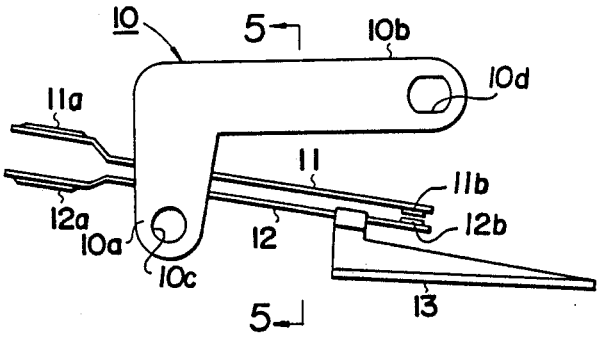
FIG. 2 is a plan view of a switch device according to this invention.
Figure 3:
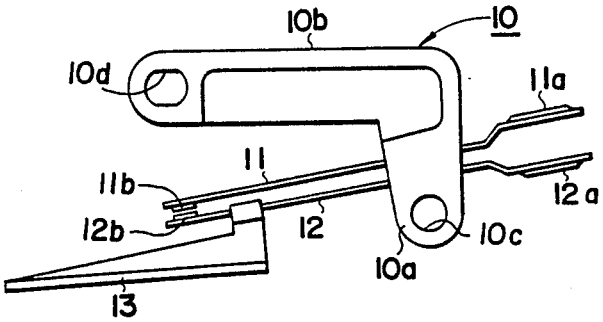
FIG. 3 is a bottom view of the same.
Figure 4:
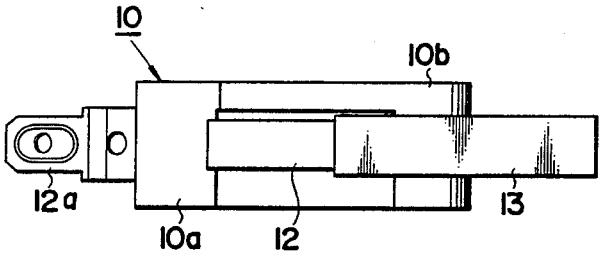
FIG. 4 is a front view of the same.
Figure 5:
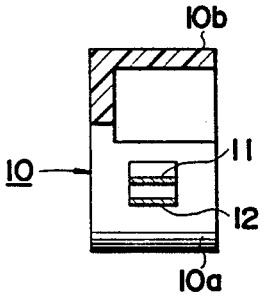
FIG. 5 is a sectional view taken on line A—A of FIG. 2.
Figure 6:
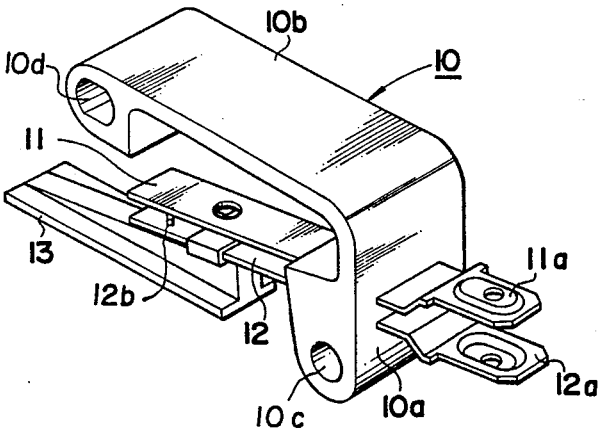
FIG. 6 is a perspective view of the same.
Figure 7:
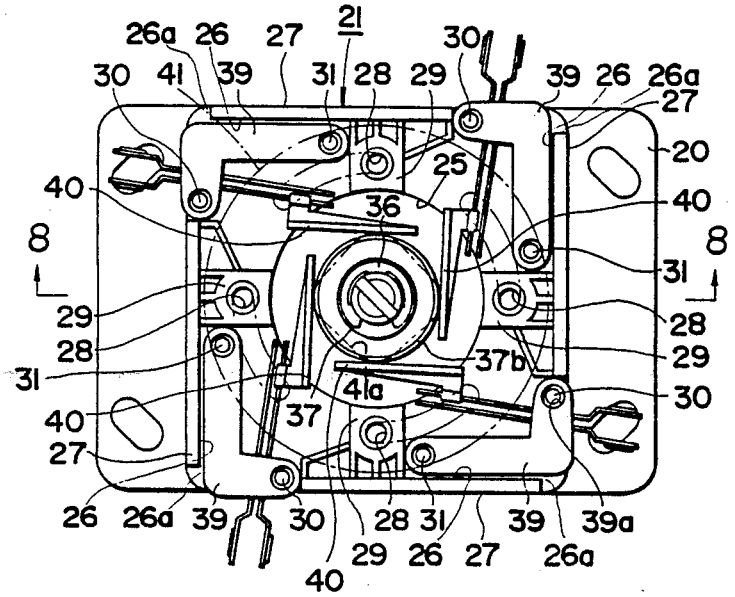
FIG. 7 is a plan view showing a switch assembly for a television game machine using a switch device according to this invention, with a control plate removed.
Figure 8:
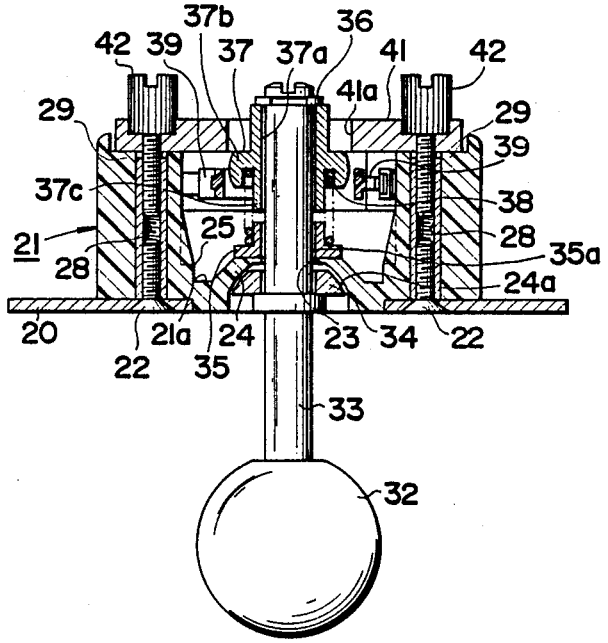
FIG. 8 is a sectional view taken on line B—B of FIG. 7.
Figure 9:
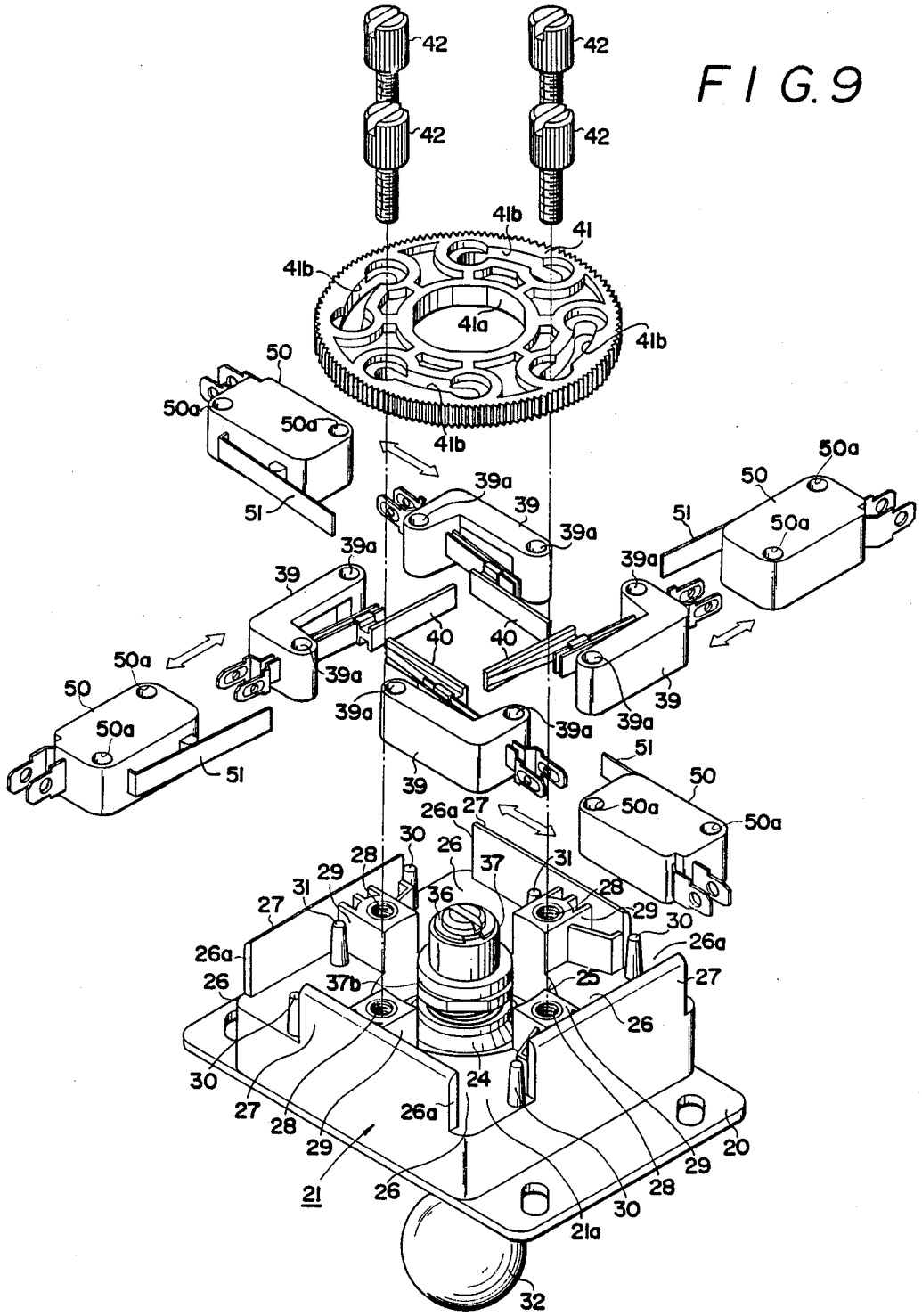
FIG. 9 is an exploded perspective view of the same.

FIGS. 6 to 9 show a switch assembly for a television game machine, for example, which uses the aforementioned switch device. A case body 21 made of a synthetic resin as shown in FIG. 8 is fixedly mounted on a base plate 20 in the shape of a substantially rectangular plane by means of screws 22 and 22. The case body 21 is in the shape of a substantially rectangular plane, and a through hole 23 is provided in a substantially central portion of a base plate portion 21*a* of the case body 21. Around this through hole 23 is coaxially provided a receiving seat portion 24 having a curve portion 24*a* which assumes a posture in which a bowl is inverted as shown in FIG. 8, and a recess 25 larger in diameter than the receiving seat portion is coaxially provided around the receiving seat portion 24 of the base plate portion 21*a*. In the periphery of the case body 21, wall portions 27 are provided which are each formed with square notches 26*a* as shown in FIG. 9 and extend upright from the base plate portion 21*a*. Spacers 29 having respectively internal threads 28 project internally in a substantially central portion of the wall portions 27. A space portion is provided between the spacers 29 and an actuator of a leaf spring switch which will be described later is inserted into the space portion so that the actuator may be pivotably moved toward a switch operating portion which will also be described later. A portion surrounded by the spacers 29 and the wall portions 27 constitute switch accommodating portions 26. The switch accommodating portions 26 are distributed around the through hole 23. Mounting pins 30, 31 extend upright from the base plate portion 21*a* as shown in FIG. 9 within the switch accommodating portions 26, in diagonal positions.

An operating rod 33 having a gripping ball 32 mounted thereon particularly as shown in FIG. 8 is inserted into the through-hole 23, said operating rod 33 having a bearing portion 34 in engagement with the curve portion 24*a* of the receiving seat portion 24 to prevent it from being slipped out upwardly of the case body 21. A receiving seat ring 35 with the operating rod 33 inserted into an insert hole 35*a* is mounted on the upper surface of the receiving seat portion 24 in a manner such that the operating rod 33 may be moved axially. A tubular switch pressing member 37 is engaged, while the operating rod 33 is inserted into an insert hole 37*a* thereof, with the tip side of the operating rod 33 by means of an E ring 36. This switch pressing member 37 has a large diameter switch pressing portion 37*b* and a small diameter stopper portion 37*c*, and is always urged toward the E ring 36 side by means of a compressed coil spring 38 resiliently provided between the receiving seat ring 35 while being wound about the operating rod 33.

Accordingly, the operating rod 33 is always urged upwardly by means of the compressed coil spring 38 but is prevented from being slipped out upwardly by means of a bearing portion 34 in engagement with the curve portion 24*a*, and is also prevented from being slipped out downwardly by means of the stopper portion 37*c* of the switch pressing member 37 in contact with the receiving seat ring 35 placed on the receiving seat portion 24.

Since the operating rod 33 is always drawn upwardly by the compressed coil spring 38 through the switch pressing member 37, the bearing portion 34 is engaged with the curve portion 24*a*, but when the operating rod 33 is pulled downwardly, it may be moved somewhat through a gap between a lower end end portion of the stopper portion 37*c* of the switch pressing member 37 and an upper end portion of the receiving seat ring 35, and when the hand is released, the rod is returned to its original position.

The operating rod 33 is pivotable in a direction of 360 degrees about the bearing portion 34 in engagement with the curve portion 24*a* of the receiving seat portion 24 but in the normal state, it is maintained at an upright state by means of the compressed coil spring 38.

Next, reference numerals 39 denote leaf spring switches having respective actuators 40. The leaf spring switches 39 each have a pair of mounting holes 39*a* at respective diagonal positions and are received along the wall portions 27 within the case body 21 and fixed by inserting the mounting pins 30, 31 into the mounting holes 39*a*, 39*a*. It is noted that one of the mounting holes 39*a*, 39*a* is in the form of a slot.

On each of the leaf spring switches 39 is placed a disk-like control plate 41 having a square guide hole 41*a* at a center portion, as shown in FIGS. 8 and 9, the control plate 41 being screwed into internal threads 28 of the spacers 29, respectively, by means of mounting screws 42, inserted into circular arc holes 41*b*, provided in the outer peripheral portion of the control plate 41.

Accordingly, even if the gripping ball 32 is held by the hand to push it in any direction around 360°, the operating rod 33 may be pivotally moved but the pivotal width thereof varies with the shape and position of the guide hole 41*a* provided in the control plate 41 in contact with the switch pressing portion 37*b* of the switch pressing member 37. Assuming now that the control plate 41 is at a position indicated by an imaginary line in FIG. 7, a corner portion provided with "R" of the square guide hole 41*a* is in a direction of X-Y in the coordinate axis, and therefore, the operating rod 33 may be pivotally moved greatly in vertical and lateral directions but merely pivotally moved slightly in directions other than the above. Accordingly, in case of the embodiment shown in FIG. 7, each of the leaf spring switches 39 is merely individually turned ON and OFF by the switch pressing portion 37*b* through the actuator 40.

However, when the mounting screws 42 are loosened to rotate the control plate 41 along the circular arc holes 41*b*, the operating rod 33 is pivotally moved to the greatest extent in a direction of an angle rotated through 45° with respect to the aforementioned vertical and lateral directions. Therefore, the microswitches 39 can be turned ON and OFF two at a time simultaneously by the switch pressing portion 37*b* through the actuators 40.

The leaf spring switches according to the present invention are simple in structure and involve less trouble and can be used without requiring maintenance for a long period of time.

Subsequently, FIG. 9 shows the case where the microswitches and the leaf switches can be replaceably mounted on the case body, in which the case body 21 has actuators 51, and mounting holes 50*a*, so that microswitches 50 (having lengths of their long portions and short portions and a whole thickness designed to be the same as those of the leaf spring switches) can be mounted in place of the leaf spring switches 39.

In this manner, both the microswitches and leaf switches can be freely selectively used according to the taste of a client or user. This results from the fact that the size and shape of the leaf spring switches are made to be the same as those of commercially available microswitches.

I claim:

1. A leaf spring switch for replacing a microswitch having a long portion of a selected length, a short portion of a selected length and a selected width, comprising:

an L-shaped base member having a long portion and a short portion with the same respective lengths as those of the microswitch, said long portion being about one half the width of said short portion, said long portion and short portion of the base member having mounted holes in diagonal positions with respect to each other;

a first leaf spring contactor fixed to said short portion, said first leaf spring contactor extending along said long portion and having a contact on one longitudinal end thereof and a terminal on an opposite longitudinal end thereof;

a second leaf spring contactor fixed to said short portion locating at an outside position with respect to said first leaf spring contactor, said second leaf contactor extending along said long portion and having a contact on one longitudinal end thereof and a terminal on an opposite longitudinal end thereof, said first leaf spring contactor and said second leaf spring contactor being opposed to each other in a spaced and parallel relationship; and an actuator mounted on said second leaf spring contactor for moving at least a part of said second leaf spring contactor with respect to said first leaf spring contactor to engage said contacts with each other.

2. A multiple switch assembly comprising:

a case body provided with a through hole;

an operating rod extending through said through hole of said case body and pivotally mounted on said case bodyl;

a plurality of switch accommodating portions formed in said case body and spaced around said through hole, said switch accommodating portions each having a pair of mounting pins;

a control plate mounted on said case body and having a guide hole through which a part of said operating rod extends, said switch accommodating portions being shaped for replaceably accommodating a plurality of leaf spring switches, each of said leaf spring switches having an actuator selectively operated by said operating rod, said leaf spring switches having mounting holes for engagement of said pairs of mounting pins, the improvement comprising:

each of said leaf spring switches comprising an L-shaped base member having a long portion and a short portion with the same respective lengths as those of a microswitch, said long portion having a width which is one half the length of said short portion, said long portion and said short portion each having mounting holes in diagonal positions with respect to each other engaged on one pair of said mounting pins, a first leaf spring contactor fixed to said short portion, said first leaf spring contactor extending along said long portion and having a contact on one longitudinal end thereof, a second leaf spring contactor fixed to said short portion located at an outside position with respect to said first leaf spring contactor, said second leaf spring contactor extending along said long portion and having a contact on one longitudinal end thereof and a terminal on an opposite longitudinal end thereof, said first leaf spring contactor and said second leaf spring contactor being opposite to each other in a spaced and parallel relationship, and said actuator mounted on said second leaf spring contactor with respect to said first leaf spring contactor.

* * * * *